US006342764B1

(12) United States Patent
Nishiura et al.

(10) Patent No.: US 6,342,764 B1
(45) Date of Patent: Jan. 29, 2002

(54) HIGH PRESSURE DISCHARGE LAMP

(75) Inventors: Yoshiharu Nishiura, Shiga; Takashi Yamamoto, Osaka; Kazuo Takeda, Osaka; Shiki Nakayama, Osaka; Hiroshi Nohara, Hyogo, all of (JP)

(73) Assignee: Matsushita Electric Industrial Co., Ltd, Osaka (JP)

( * ) Notice: Subject to any disclaimer, the term of this patent is extended or adjusted under 35 U.S.C. 154(b) by 0 days.

(21) Appl. No.: 09/575,940

(22) Filed: May 23, 2000

(30) Foreign Application Priority Data

May 24, 1999 (JP) ..... 11-143392

(51) Int. Cl.[7] ..... H01J 17/04

(52) U.S. Cl. ..... 313/631; 313/632; 313/639; 313/574; 315/46

(58) Field of Search ..... 313/631, 632, 313/639, 633, 628, 569, 571, 574, 578, 579, 491; 315/46, 97, 95, 96

(56) References Cited

U.S. PATENT DOCUMENTS

| | | | | |
|---|---|---|---|---|
| 4,475,061 A | | 10/1984 | Van de Weijer et al. | 313/623 |
| 4,910,430 A | * | 3/1990 | Ito et al. | 313/566 |
| 5,424,609 A | | 6/1995 | Geven et al. | 313/623 |
| 5,552,670 A | * | 9/1996 | Heider et al. | 313/625 |
| 5,654,606 A | * | 8/1997 | Weijtens et al. | 313/491 |
| 5,856,726 A | * | 1/1999 | Evans et al. | 313/491 |
| 5,905,341 A | * | 5/1999 | Ikeuchi et al. | 313/639 |

FOREIGN PATENT DOCUMENTS

| | | |
|---|---|---|
| JP | 55-136449 | 10/1980 |
| JP | 57-78763 | 5/1982 |
| JP | 61-245457 | 10/1986 |
| JP | 62-283543 | 12/1987 |
| JP | 6-196131 | 7/1994 |
| JP | 7-21981 | 1/1995 |
| JP | 7-240184 | 9/1995 |
| JP | 9-92204 | 4/1997 |
| JP | 9-129178 | 5/1997 |
| JP | 10-134768 | 5/1998 |
| JP | 11-96973 | 4/1999 |

* cited by examiner

*Primary Examiner*—David Vu
*Assistant Examiner*—Tuyet T. Vo
(74) *Attorney, Agent, or Firm*—Merchant & Gould P.C.

(57) ABSTRACT

A discharge tube is provided inside an outer tube. At least a pair of electrodes is arranged inside the discharge tube, and at least mercury is sealed into the discharge tube. The electrode includes an electrode pin and a metal pipe that surrounds the electrode pin. Because a contact area of the electrode pin and the inner surface of the metal pipe is sufficiently maintained in a stable manner, a tip temperature of the electrode pin can be lowered sufficiently without a variation. As a result, it is possible to obtain a high pressure discharge lamp that has excellent lifetime characteristics and can considerably reduce the variation of the lifetime characteristics between lamps.

8 Claims, 8 Drawing Sheets

HIGH PRESSURE DISCHARGE LAMP

BACKGROUND OF THE INVENTION

1. Field of the Invention

The present invention relates to a high pressure discharge lamp. It relates in particular to a high pressure discharge lamp that is characterized by electrodes inside a discharge tube.

2. Description of the Prior Art

In general, a conventional electrode inside a discharge tube of a high pressure discharge lamp includes an electrode pin made of tungsten and an electrode coil made of tungsten that surrounds the electrode pin.

The known electrode coil is formed by which a wire having a smaller wire diameter than that of the electrode pin is coiled to make one or two layers around the electrode pin. Further known structures are that with a tip of the electrode pin located in the electrode coil and that with the tip of the electrode pin being in the same plane as or protruding beyond an end of the electrode coil in the central side of the discharge tube.

The purpose of providing the electrode coil to the electrode pin is to lower the temperature of the tip of the electrode pin during the discharge so as to achieve an optimal temperature, thereby reducing the evaporation of tungsten on the tip of the electrode pin and suppressing the blackening of the discharge tube. It is another important purpose to form the electrode coil with a thin wire, thereby increasing the electrolytic strength and improving the startup performance of the lamp.

In order to optimize the tip temperature of the electrode pin to improve its lifetime characteristics, studies have been conducted on the wire diameters of the electrode pin and the electrode coil, and the coiling number and shape of the electrode coil.

In such a conventional electrode of the high pressure discharge lamp, the electrode pin and the electrode coil are fixed to each other by welding or a mechanical insertion (that is, a method for obtaining the fitting strength by making the inner diameter of the electrode coil slightly smaller than the outer diameter of the electrode pin and mechanically pushing the electrode pin into the electrode coil). However, since the electrode coil is formed with a wire, the contact area of the electrode pin and the electrode coil is very small, and thus is less effective in lowering the tip temperature of the electrode pin.

Moreover, because the contact area varies considerably depending on electrodes, the tip temperature of the electrode pin varies correspondingly. This generates a variation of the evaporation degree of tungsten on the tip of the electrode. When an evaporation amount of tungsten is great, leading to a large deterioration of the electrode tip, the evaporated tungsten adheres to the inner surface of a discharge tube so that the discharge tube blackens, thus considerably reducing a light flux of the lamp. Furthermore, higher temperature of the discharge tube and higher lamp voltage are caused so as to accelerate the dying out of the lamp. Moreover, when the electrode coil is formed by dense coiling and gaps occur between coil pitches, then the thermal conduction is greatly lowered, making the above problems still more serious.

SUMMARY OF THE INVENTION

It is an object of the present invention to solve the problems mentioned above and to provide a high pressure discharge lamp that has excellent lifetime characteristics and can considerably reduce the variation of the lifetime characteristics between lamps.

In order to achieve the above-mentioned object, the present invention has the following configuration.

A high pressure discharge lamp according to the present invention includes a discharge tube, a pair of electrodes comprising an electrode pin and a metal pipe surrounding the electrode pin arranged inside the discharge tube, and mercury sealed in the discharge tube.

With this configuration, a contact area of the electrode pin and the inner surface of the metal pipe is maintained sufficiently, thereby sufficiently lowering a tip temperature of the electrode pin. Also, since the contact areas in the electrodes are uniform, a variation of the tip temperatures of the electrode pins can be reduced, thereby reducing the variation of the electrode temperatures of the lamps. As a result, it is possible to provide the high pressure discharge lamp that has excellent lifetime characteristics and considerably can reduce the variation of the lifetime characteristics between lamps.

DESCRIPTION OF THE PREFERRED EMBODIMENTS

The following is a description of the preferred embodiments, with reference to the accompanying drawings.

Figure 1:
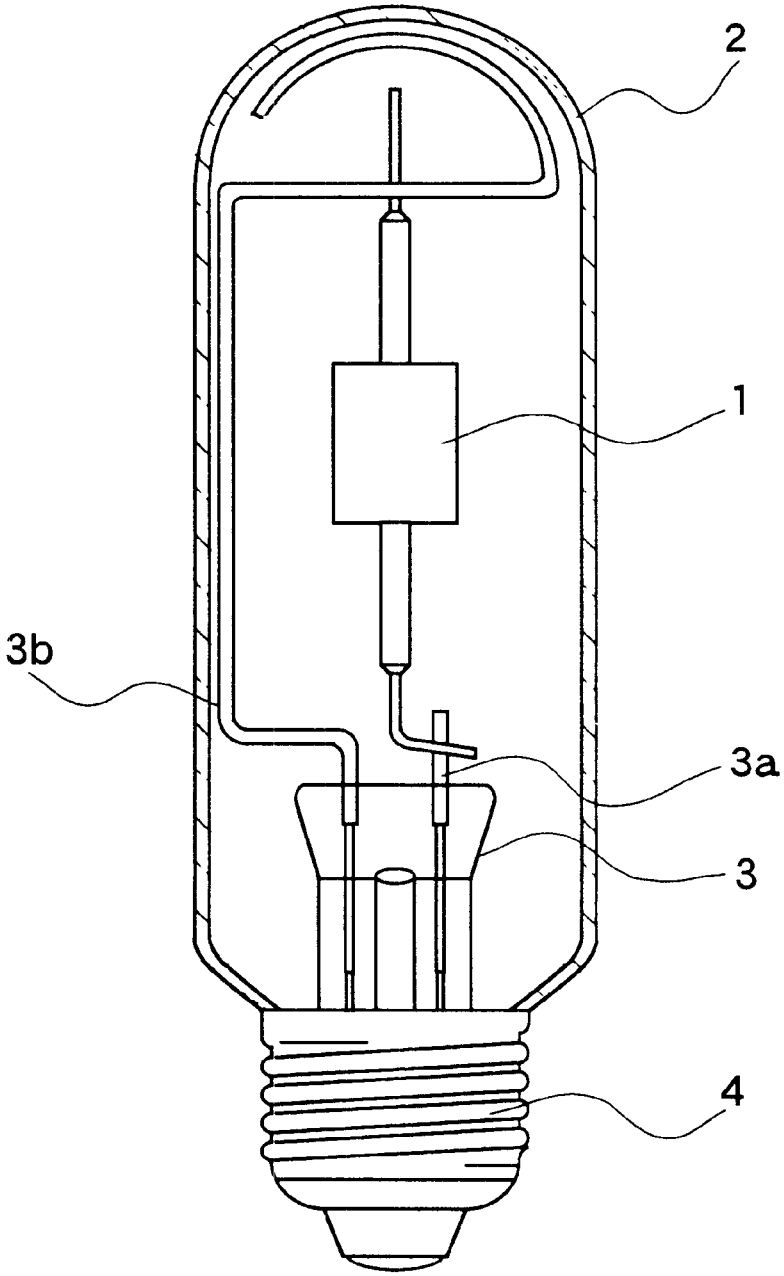
FIG. 1 is a partially broken front elevation of a metal halide lamp according to one embodiment of the present invention.

FIG. 1 shows a 70 W metal halide lamp in accordance with a first embodiment of the present invention. A discharge tube 1 made of ceramics is rigidly supported by metal wires 3*a* and 3*b* inside an outer tube 2. One end of the outer tube 2 is provided with a stem 3, which seals the outer tube 2 air-tightly.

A predetermined amount of mercury, argon as a noble gas for a starting gas, and iodides of dysprosium (Dy), thulium (Tm), holmium (Ho), thallium (Tl) and sodium (Na) as metal halides are sealed in the discharge tube 1. Numeral 4 denotes a lamp base.

Figure 2:
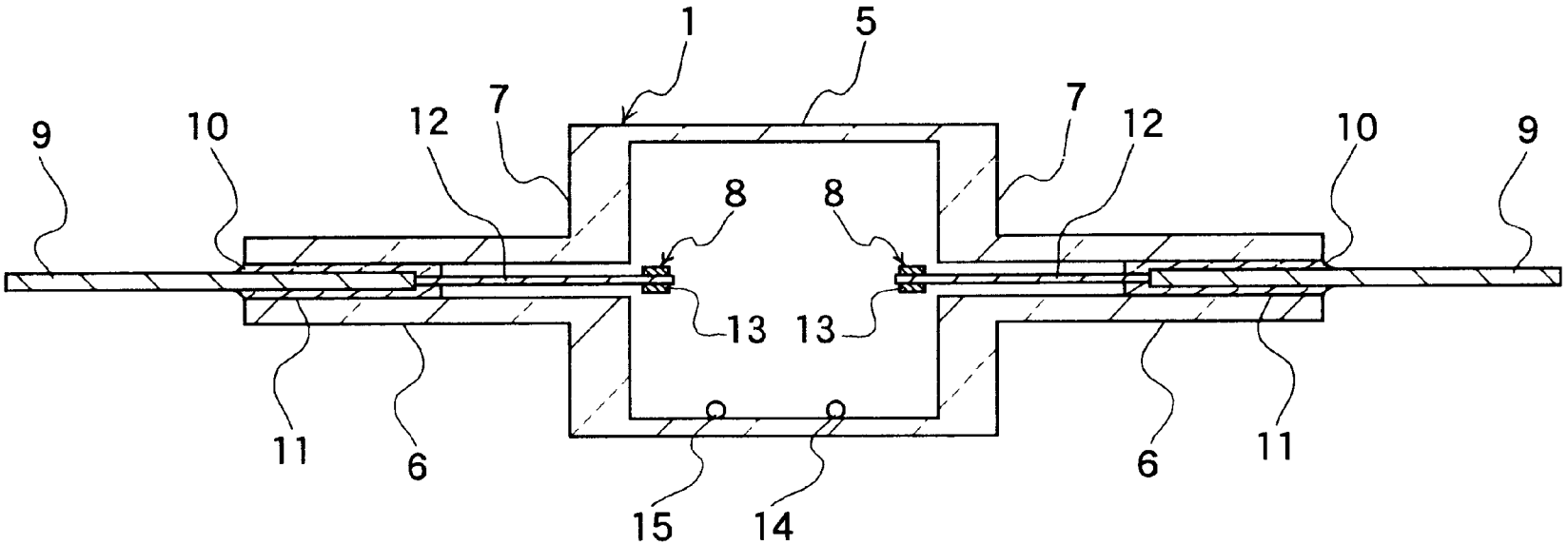
FIG. 2 is a cross-sectional front elevation of a discharge tube of the lamp of FIG. 1.

FIG. 2 is a cross-sectional view illustrating a schematic configuration of the discharge tube in accordance with the present embodiment. As is shown in FIG. 2, the discharge tube 1 made of ceramics includes a main cylindrical portion 5 with an outer diameter of 7.8 mm and a wall thickness of 0.6 mm and tubular cylindrical portions 6 with an outer diameter of 2.6 mm and an inner diameter of 0.8 mm provided at both end portions of the main cylindrical portion 5. The main cylindrical portion 5 and the tubular cylindrical portions 6 are sintered into one piece with ring portions 7 with a wall thickness of 1.7 mm.

Lead-in wires 9 having an electrode 8 at the tip portion thereof are inserted into both of the tubular cylindrical portions 6 such that the tip of electrode 8 is located inside the main cylindrical portion 5. The lead-in wire 9 is sealed in the tubular cylindrical portion 6 with a sealing material 10, and a sealing portion 11 is formed in the tubular cylindrical portion 6.

Figure 3:
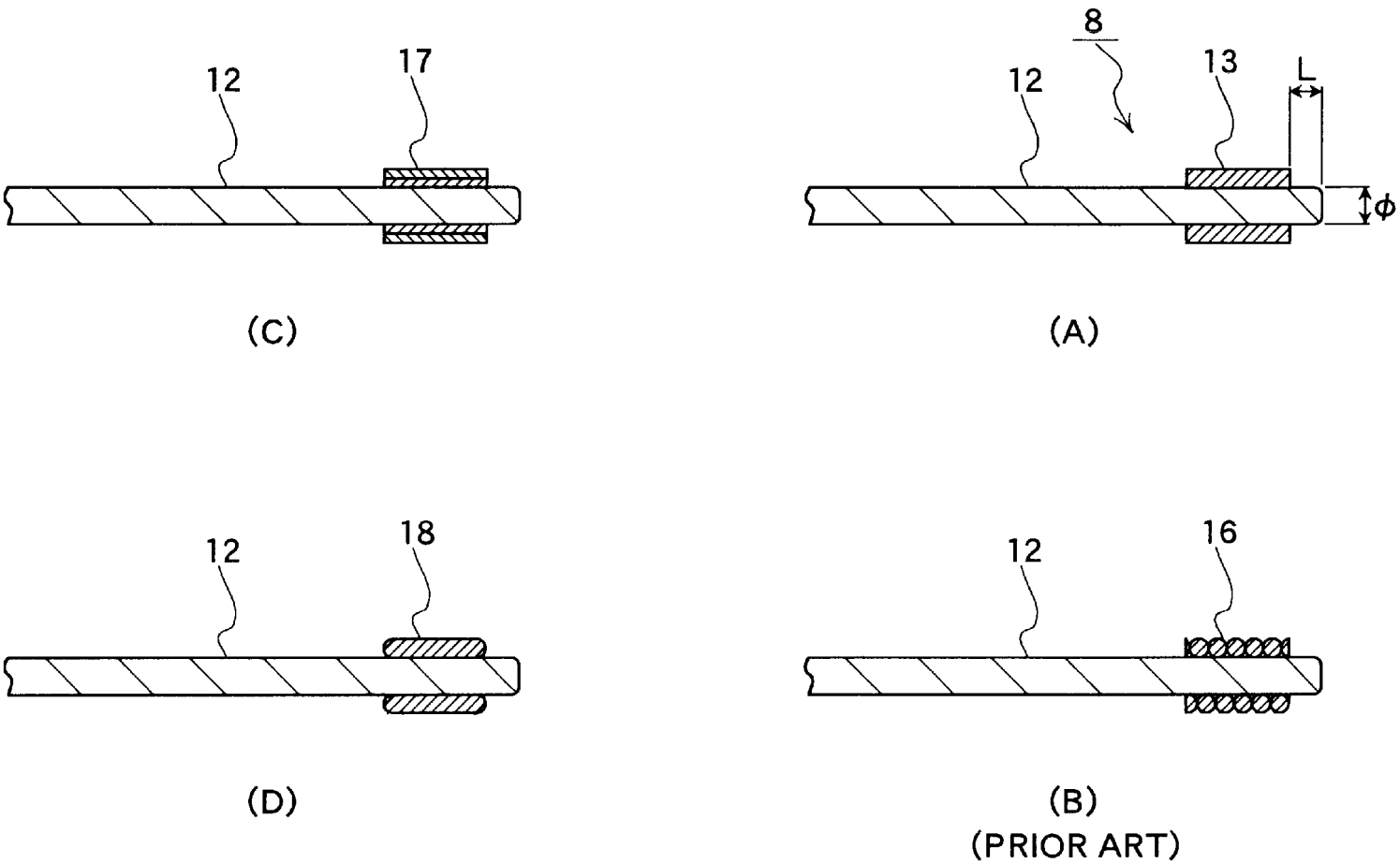
FIGS. 3(A), (C) and (D) are cross-sectional front elevations of electrodes having a metal pipe of one embodiment of the present invention.
FIG. 3(B) is a cross-sectional front elevation of an electrode having a conventional electrode coil.

As is shown in FIG. 3(A), the electrode 8 includes an electrode pin 12 made of tungsten with an outer diameter $\phi$ of 0.4 mm and a metal pipe 13 made of tungsten with a wall thickness of 0.2 mm and an entire length of 1.5 mm that surrounds the electrode pin 12. The metal pipe 13 is welded and fixed to the electrode pin 12. The electrode pin 12 protrudes beyond the end of the metal pipe 13 towards the center of the discharge tube, and the protrusion length L is 1.0 mm.

In addition, numeral 14 denotes a mercury pellet, and numeral 15 denotes an iodide pellet in FIG. 2.

The lamp of one example of the present invention formed according to the configuration described above is called a lamp A.

As a comparative example, a lamp of a conventional configuration using an electrode coil as shown in FIG. 3(B) was evaluated at the same time. The electrode shown in FIG. 3(B) is configured such that an electrode coil 16 made of a tungsten wire with a wire diameter of 0.1 mm is coiled to obtain two layers around the same electrode pin 12 as that of the lamp A (for simplification, only one layer is shown in the figure). The entire length of the portion of the electrode coil 16 is 1.5 mm, which is the same as the lamp A of one example of the present invention. The lamp using this electrode coil 16 is called a lamp B.

Twenty lamps each for the lamp A and the lamp B were produced to evaluate their lifetimes.

Figure 4:
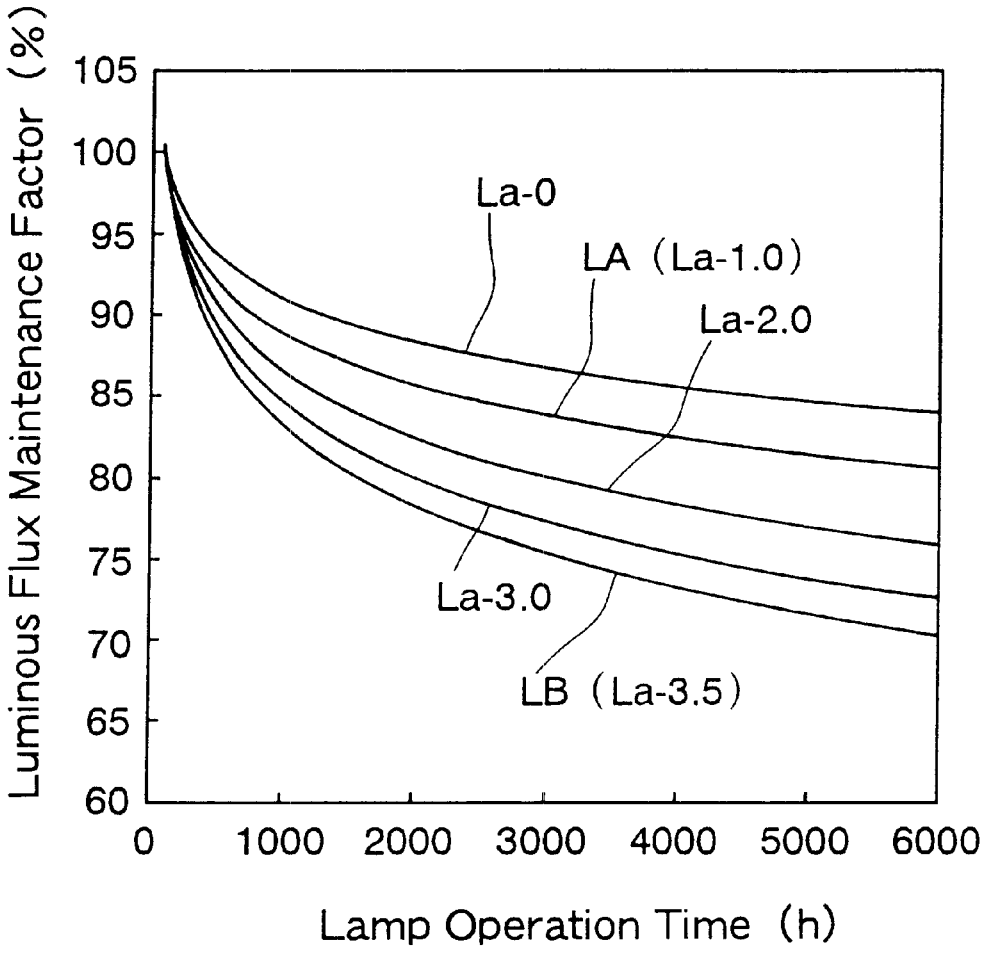
FIG. 4 is a graph showing luminous flux maintenance factors of a lamp of one embodiment of the present invention and a conventional lamp.

FIG. 4 shows the result of the lifetime evaluation. The luminous flux maintenance factor (%) in the vertical axis equals ((light flux value of a certain period of time after turning on the lamp)/(total light flux value of 100 hours after turning on the lamp)×100). FIG. 4 shows a mean value of the twenty evaluated lamps. In FIG.4, the luminous flux maintenance factor of the lamp A is expressed by LA, and that of the lamp B is expressed by LB.

Comparing the luminous flux maintenance factors after 6000 hours use, it is clearly shown by FIG. 4 that the luminous flux maintenance factor of the lamp B, which is a conventional product, is 70%, while that of the lamp A, which is one example of the present invention, is 80%. In addition, the lamp A had a smaller degree of the discharge tube blackening. In other words, it was confirmed that the present invention could achieve excellent lifetime characteristics.

Table. 1 shows the luminous flux maintenance factors of the respective lamps after 6000 hours use.

TABLE 1

| No. | Luminous flux maintenance factor of lamp A (%) | Luminous flux maintenance factor of lamp B (%) |
|---|---|---|
| 1 | 80 | 70 |
| 2 | 82 | 62 |
| 3 | 81 | 68 |
| 4 | 78 | 68 |
| 5 | 79 | 61 |
| 6 | 83 | 72 |
| 7 | 81 | 73 |
| 8 | 76 | 75 |
| 9 | 83 | 74 |
| 10 | 80 | 78 |
| 11 | 75 | 65 |
| 12 | 79 | 73 |
| 13 | 83 | 72 |
| 14 | 80 | 60 |
| 15 | 81 | 65 |
| 16 | 83 | 75 |
| 17 | 77 | 71 |
| 18 | 76 | 77 |
| 19 | 83 | 62 |
| 20 | 80 | 70 |
| Mean value | 80.0 | 69.6 |
| Standard deviation | 2.6 | 5.5 |

In Table 1, the variations of the luminous flux maintenance factors of the lamps A and B are expressed by a standard deviation $\sigma$.

It is clearly shown by Table 1 that the standard deviation $\sigma$ of the luminous flux maintenance factor of the lamp B, which is a conventional product, is 5.5, while that of the lamp A, which is one example of the present invention, is 2.6. This confirmed that, by using the metal pipe 13 of the present invention, the tip temperatures of the electrode pins 12 in all lamps are made more uniform, reducing the variation of the lifetime characteristics between lamps.

In addition, when using a two-layer metal pipe 17 with a wall thickness of 0.1 mm as is shown in FIG. 3(C), similar effects of improving lifetime and reducing lifetime variation could be achieved.

Next, in the 70 W metal halide lamp shown in FIG. 1, the configuration of the electrode 8 shown in FIG. 3(A) was used. Denoting the outer diameter of the electrode pin 12 by $\phi$ and the length that the electrode pin 12 protrudes beyond the metal pipe 13 towards the center of the discharge tube by L, the lifetimes when the outer diameter $\phi$ was set to 0.4 mm were evaluated for five different protrusion lengths L, namely 0 mm, 1.0 mm, 2.0 mm, 3.0 mm and 3.5 mm, as a parameter.

FIG. 4 also shows these results. In FIG. 4, the luminous flux maintenance factors of individual cases where the protrusion lengths L are 0 mm, 1.0 mm, 2.0 mm, 3.0 mm and 3.5 mm are expressed by La-0, La-1.0, La-2.0, La-3.0 and La-3.5.

As is clearly shown in FIG. 4, as the protrusion length L becomes longer, the luminous flux maintenance factor after 6000 hours use declines. When the protrusion length L is 3.5 mm, the luminous flux maintenance factor is the same as that of the lamp B of the conventional electrode configuration. In other words, the longer the protrusion length L becomes, the smaller the effect of lowering the tip temperature of the electrode pin 12 becomes, leading to the evaporation of tungsten on the tip of the electrode pin and blackening of the discharge tube in a larger degree.

Furthermore, in 100 W, 150 W and 250 W metal halide lamps similar to that of the first embodiment of the present invention, the electrode having the configuration shown in FIG. 3(A) was used to evaluate the lifetime in a similar manner. The result confirmed that the lamps of all types achieved better lifetime characteristics and smaller variation of the lifetime characteristics between lamps than the lamp using the conventional electrode configuration shown in FIG. 3(B).

Next, the outer diameter $\phi$ of the electrode pin 12 was changed according to wattages and the protrusion length L was used as a parameter so that the lifetimes were evaluated.

Figure 5:
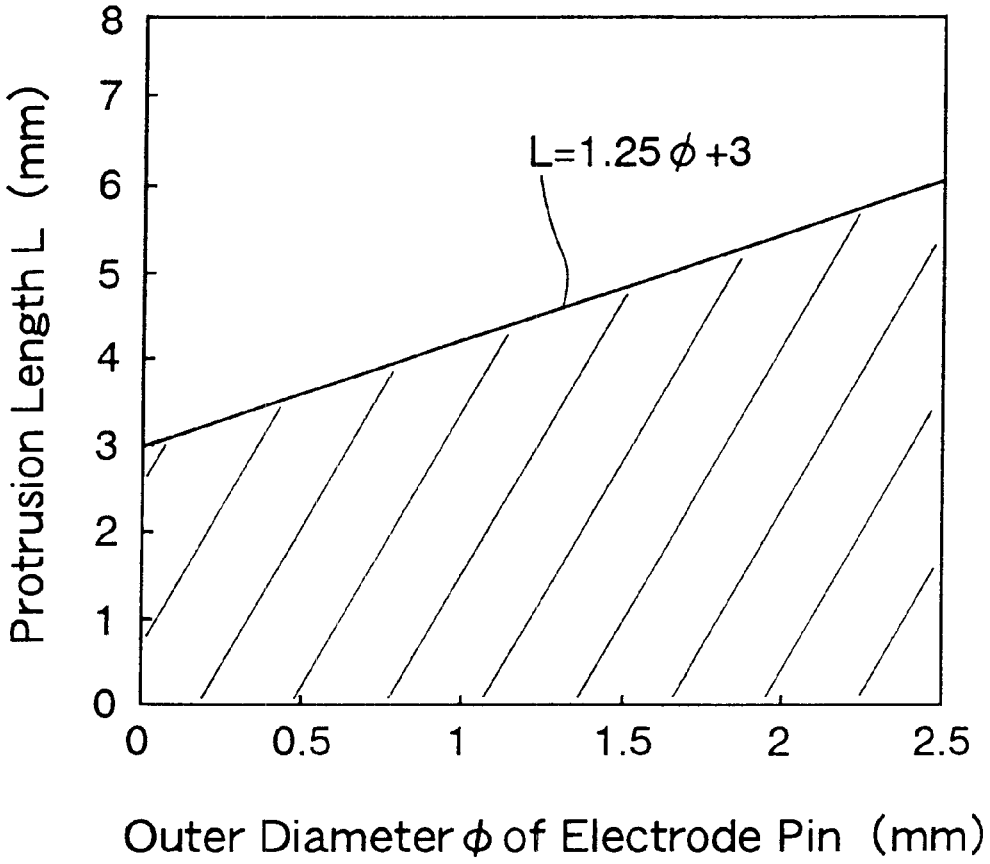
FIG. 5 is a graph showing the relation between the outer diameter of an electrode pin and the protrusion length.

The result confirmed that, when a lamp design satisfies the relationship of the hatched area in FIG. 5, namely $L \leqq 1.25 \times \phi + 3.0$, the lamps of all types achieved better lifetime characteristics than the lamp using the electrode coil 16, which is the conventional electrode configuration. This was because an excessively longer protrusion length L reduces the effect of lowering the tip temperature of the electrode pin 12.

Next, in the 70 W metal halide lamp of the first embodiment of the present invention shown in FIG. 1, a metal pipe 18 both of whose end portions are processed by polishing as shown in FIG. 3(D) was used to evaluate the lifetime.

Figure 6:
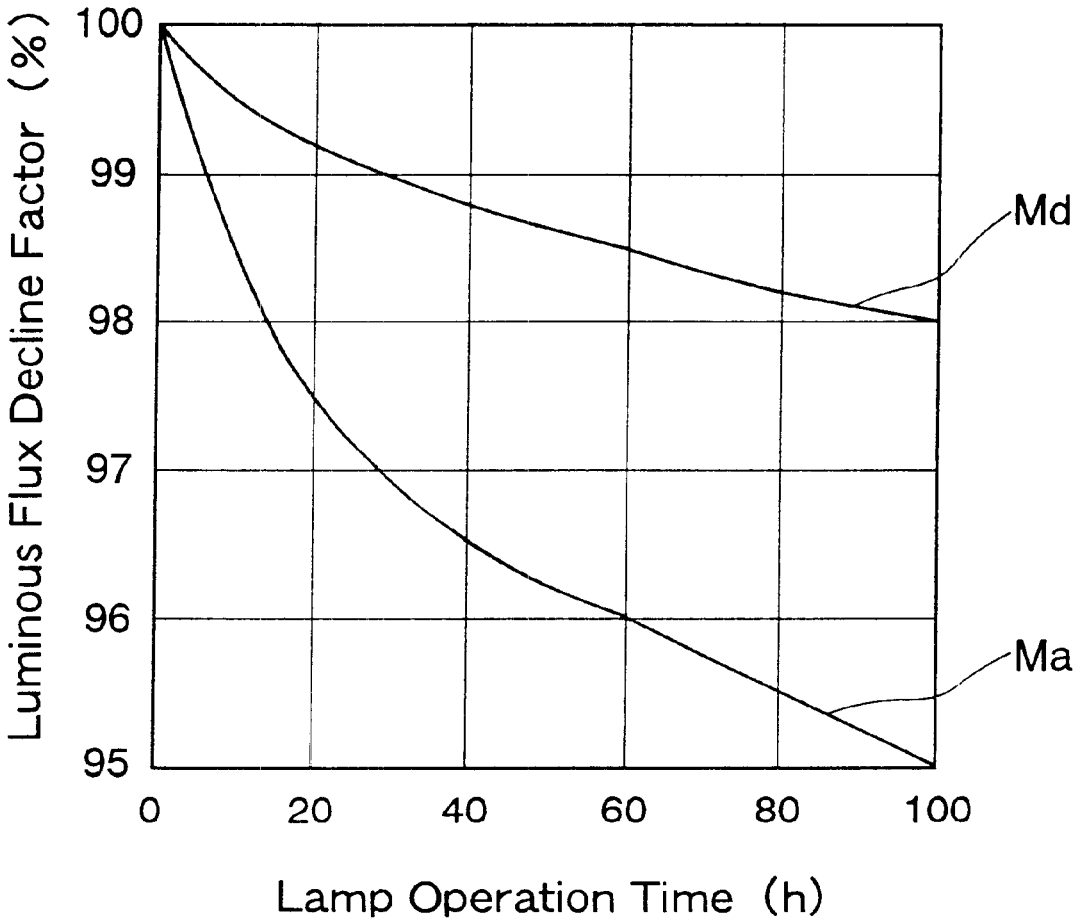
FIG. 6 is a graph showing luminous flux decline factors of lamps of one embodiment of the present invention.

The result is shown in FIG. 6. At the same time, the lamp using the metal pipe 13 shown in FIG. 3(A) was evaluated, and the luminous flux decline factors from the start of the lamp operation to 100 hours after use were compared between both lamps.

The luminous flux decline factor (%) was calculated with ((light flux value of a certain time)/(light flux value of the start of lamp operation)×100).

In FIG. 6, the luminous flux decline factor of the lamp using the metal pipe 13 in FIG. 3(A) was expressed by Ma, and that using the metal pipe 18 whose end portions are processed by polishing in FIG. 3(D) was expressed by Md.

As is clearly shown in FIG. 6, the lamp using the metal pipe 18 whose end portions are processed by polishing showed better lifetime characteristics. Both lamps showed the same tendency of luminous flux deterioration at the 100 hours or longer operation time.

This is because the metal pipe 13 whose end portions are not processed by polishing has a burr on the cut surface in the end portions thereof, and the local temperature of the burr portion rises during the lamp operation, causing tungsten to evaporate in the discharge tube. Since the tungsten in the burr portion finishes evaporating by the time approximately 100 hours has passed after the start of the lamp operation, the metal pipes 13 and 18 show the same tendency of luminous flux deterioration at the 100 hours or longer operation time. In other words, it could be confirmed that polishing the end portions of the metal pipe to remove the burr provided a more preferable structure as a metal pipe in reducing an early light flux deterioration. Although it is not always necessary that the both ends of the metal pipe are processed by polishing, it is preferable that the both ends are polished because the effect described above becomes more apparent.

Figure 7:
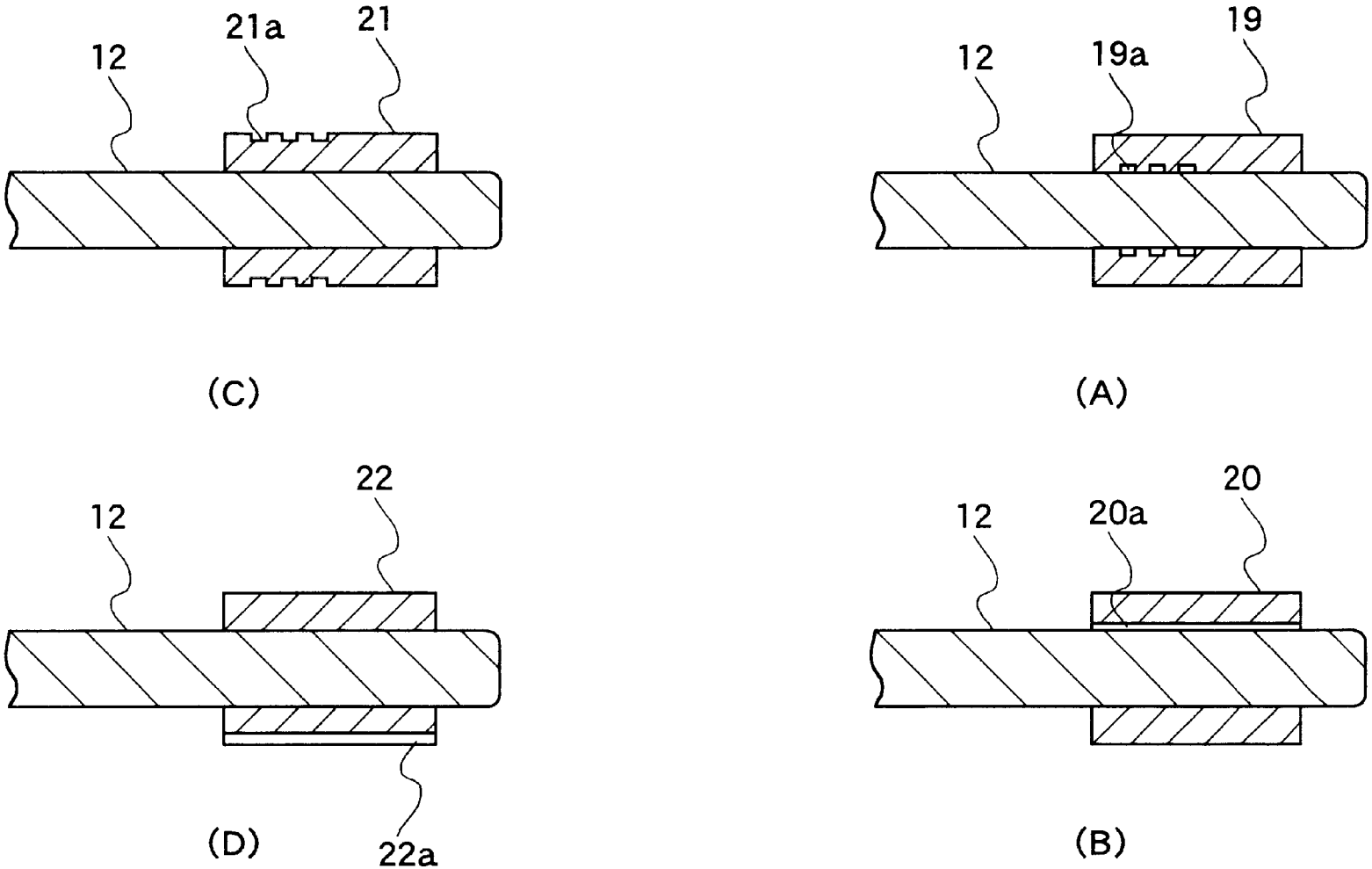
FIGS. 7(A) to (D) are cross-sectional front elevations of another configuration of electrodes used in the lamp of the present invention.

FIG. 7 shows another configurational example of the metal pipe of the electrode in accordance with the present invention. FIG. 7(A) shows a metal pipe 19 that is provided with roughness on its internal circumferential surface by forming grooves 19*a* in the circumferantial direction. Also, FIG. 7(B) shows a metal pipe 20 that is provided with roughness on its internal circumferential surface by forming grooves 20*a* in the longitudinal direction. Such metal pipes 19 and 20 that are made of tungsten and are provided with the roughness on their internal surfaces, as shown in FIGS. 7(A) and (B), are advantageous in that welding to the electrode pin 12 can be performed easily.

FIG. 7(C) shows a metal pipe 21 that is provided with roughness on its external circumferential surface by forming grooves 21*a* in the circumferantial direction. Also, FIG. 7(D) shows a metal pipe 22 that is provided with roughness on its external circumferential surface by forming grooves 22*a* in the longitudinal direction. Such metal pipes 21 and 22 that are made of tungsten and are provided with the roughness on their external surfaces, as shown in FIGS. 7(C) and (D), also are advantageous in that welding to the electrode pin 12 can be performed easily. This is because the contact portion of the electrode pin and the metal pipe becomes easier to melt during welding.

The roughness in the circumferential direction as in FIGS. 7(A) and (C) may be formed only on a part of the longitudinal direction of, as is shown in the figure, or across an entire length of the metal pipe. On the other hand, the roughness in the longitudinal direction as in FIGS. 7(B) and (D) may be formed only on a part of the circumferential direction of, as is shown in the figure, or around an entire circumference of the metal pipe. In addition, the roughness may be provided to both internal and external circumferential surfaces. Furthermore, instead of providing a groove (or a rib) as shown in the figures, the roughness may be formed by providing a dotted convex or concave portion.

Figure 8:
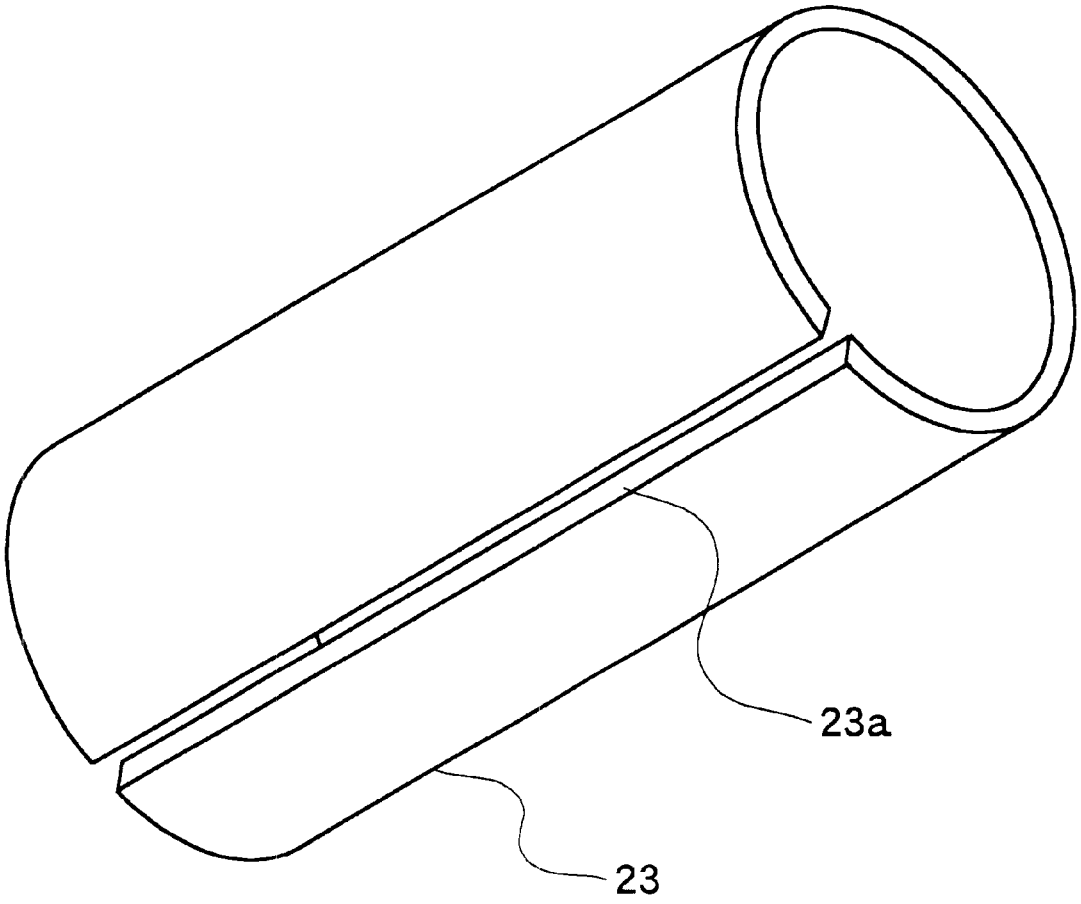
FIG. 8 is a perspective view illustrating another configuration of a metal pipe used in the lamp of the present invention.

Although the above embodiment described an annular metal pipe as the metal pipe 13, using a partially cut-out metal pipe 23 that is provided with a slit 23*a* in the longitudinal direction as shown in FIG. 8 also can improve lifetime and the variation of lifetime characteristics between lamps. The shape of the cut-out portion is not limited to that of the slit formed across an entire length in the longitudinal direction, which is shown in FIG. 8. For example, it can be changed optionally into a slit formed only in a part of the longitudinal direction, a slit formed spirally in a predetermined length, a notch formed in a part of an end portion, an opening penetrating a part of its external circumference, or the like. In the present invention, the metal pipe "surrounds" the electrode pin. This "surrounding" includes not only surrounding an entire circumference of the electrode pin as the metal pipe 13 does, but substantially surrounding the electrode pin with a metal pipe having a cut-out portion such as that in FIG. 8.

Furthermore, in the present embodiment, tungsten was used as a material for the metal pipe 13. However, it is confirmed that a metal pipe formed with tungsten containing approximately 2 wt % of thorium (Th) also can be improve the lifetime and the variation of lifetime characteristics between lamps, and even achieves a better startup performance.

Moreover, the embodiment of the present invention described a metal halide lamp using a transparent ceramic as the discharge tube 1. However, instead of the transparent ceramic, quartz may be used. There is no particular limitation concerning the material for the discharge tube as long as it has excellent thermal resistance and transmittance.

In addition, the embodiment of the present invention described a lamp using, besides mercury and argon (Ar), iodides of dysprosium (Dy), thulium (Tm), holmium (Ho), sodium (Na) and thallium (Tl) as a material to be sealed in the discharge tube. However, instead of argon (Ar), xenon (Xe) or neon (Ne) may be used. Also, there is no limitation concerning the kind of or even presence or absence of halide.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A high pressure discharge lamp comprising:

a discharge tube;

a pair of electrodes comprising an electrode pin and a metal pipe surrounding said electrode pin arranged inside said discharge tube; and mercury sealed in said discharge tube;

wherein said metal pipe is provided at a discharge end of said electrode pin.

2. The high pressure discharge lamp according to claim 1, satisfying $L \leqq 1.25 \times \phi 3.0$, wherein $\phi$ denotes an outer diameter of said electrode pin in mm and L denotes in mm a length that said electrode pin protrudes beyond said metal pipe toward the center of said discharge tube.

3. The high pressure discharge lamp according to claim 1, wherein at least a part of said metal pipe is cut out.

4. The high pressure discharge lamp according to claim 1, wherein at least one end of said metal pipe is processed by polishing.

5. The high pressure discharge lamp according to claim 1, wherein said metal pipe has roughness on at least a part of its internal surface.

6. The high pressure discharge lamp according to claim 1, wherein said metal pipe has roughness on at least a part of its external surface.

7. The high pressure discharge lamp according to claim 1, wherein a main material for said metal pipe is tungsten.

8. The high pressure discharge lamp according to claim 1, wherein a material for said metal pipe comprises thorium (Th).

* * * * *